US008156744B2

(12) United States Patent
Hernandez et al.

(10) Patent No.: US 8,156,744 B2
(45) Date of Patent: Apr. 17, 2012

(54) ANNULAR COMBUSTION CHAMBER FOR A GAS TURBINE ENGINE

(75) Inventors: Didier Hippolyte Hernandez, Quiers (FR); Thomas Olivier Marie Noel, Vincennes (FR)

(73) Assignee: SNECMA, Paris (FR)

( * ) Notice: Subject to any disclaimer, the term of this patent is extended or adjusted under 35 U.S.C. 154(b) by 839 days.

(21) Appl. No.: 12/233,943

(22) Filed: Sep. 19, 2008

(65) Prior Publication Data

US 2009/0077976 A1 Mar. 26, 2009

(30) Foreign Application Priority Data

Sep. 21, 2007 (FR) ..... 07 06644

(51) Int. Cl.
*F02C 1/00* (2006.01)
*F02G 3/00* (2006.01)

(52) U.S. Cl. ..... 60/752; 60/755; 60/746; 60/804

(58) Field of Classification Search ..... 60/752–760, 60/746, 747, 748, 804, 796, 800
See application file for complete search history.

(56) References Cited

U.S. PATENT DOCUMENTS

| | | | | | |
|---|---|---|---|---|---|
| 4,222,230 | A * | 9/1980 | Bobo et al. | ..... | 60/804 |
| 4,843,825 | A * | 7/1989 | Clark | ..... | 60/756 |
| 5,419,115 | A * | 5/1995 | Butler et al. | ..... | 60/804 |
| 5,463,864 | A * | 11/1995 | Butler et al. | ..... | 60/796 |
| 5,974,805 | A * | 11/1999 | Allen | ..... | 60/740 |
| 6,164,074 | A * | 12/2000 | Madden et al. | ..... | 60/752 |
| 6,212,870 | B1 * | 4/2001 | Thompson et al. | ..... | 60/772 |
| 6,279,323 | B1 * | 8/2001 | Monty et al. | ..... | 60/752 |
| 6,550,251 | B1 * | 4/2003 | Stickles et al. | ..... | 60/776 |
| 7,121,095 | B2 * | 10/2006 | McMasters et al. | ..... | 60/746 |
| 7,415,826 | B2 * | 8/2008 | McMasters et al. | ..... | 60/748 |
| 7,478,534 | B2 * | 1/2009 | Guezengar et al. | ..... | 60/796 |
| 7,673,460 | B2 * | 3/2010 | Hernandez et al. | ..... | 60/796 |
| 7,770,398 | B2 * | 8/2010 | De Sousa et al. | ..... | 60/752 |
| 7,861,531 | B2 * | 1/2011 | Bunel et al. | ..... | 60/752 |
| 7,954,327 | B2 * | 6/2011 | Pieussergues et al. | ..... | 60/756 |
| 2007/0084215 | A1 | 4/2007 | Hernandez et al. | | |
| 2007/0186558 | A1 | 8/2007 | De Sousa et al. | | |
| 2007/0199329 | A1 | 8/2007 | Hernandez et al. | | |

FOREIGN PATENT DOCUMENTS

| | | |
|---|---|---|
| EP | 1 731 839 A2 | 12/2006 |
| EP | 1 818 615 A1 | 8/2007 |
| EP | 1 826 492 A1 | 8/2007 |
| FR | 2 673 454 | 9/1992 |

* cited by examiner

*Primary Examiner* — William H Rodriguez
(74) *Attorney, Agent, or Firm* — Oblon, Spivak, McClelland, Maier & Neustadt, L.L.P.

(57) ABSTRACT

An annular gas turbine engine combustion chamber including an outer wall and an inner wall connected by a wall forming the chamber bottom is disclosed. The walls delimit sources of combustion with axes inclined relative to the axis of the chamber. The chamber-bottom wall, of frustoconical shape, is pierced with orifices for the fuel injection systems, the planes of the orifices being perpendicular to the axes of the sources of combustion. The combustion chamber also includes heat-protection baffles centered on each of the orifices with a shoulder by which they rest against a flat surface portion along the periphery of the orifices. The chamber-bottom wall is conformed in a succession of adjacent flat facets having a common edge, with one facet per orifice, and the shoulder of the deflectors pressing against the plane of the facets.

9 Claims, 3 Drawing Sheets

ANNULAR COMBUSTION CHAMBER FOR A GAS TURBINE ENGINE

The present invention relates to the field of gas turbine engines, its subject being the annular combustion chambers of these engines and more particularly the combustion-chamber bottoms.

BACKGROUND OF THE INVENTION

A conventional annular combustion chamber is illustrated in FIG. 1. It is an axial half-section relative to the axis of the engine of such a chamber, the other half being deduced by symmetry relative to this axis. The combustion chamber 110 is housed in a plenum chamber 130 which is an annular space defined between an outer casing 132 and an inner casing 134, into which the compressed air is injected originating from an upstream compressor, not shown, via an annular distribution duct 136. This conventional combustion chamber 110 comprises an outer wall 112 and an inner wall 114 that are coaxial and substantially conical in order to make the connection between the compressor stream and the turbine stream. The outer wall 112 and internal wall 114 are connected together at the upstream end by a wall forming the chamber bottom 116.

The chamber bottom is an annular frustoconical part which extends between two substantially transverse planes while widening out from downstream to upstream. The chamber bottom is connected to each of the two walls 112 and 114 by annular flanges 116*e* and 116*i*.

The chamber bottom is pierced with orifices 118 through which the systems 120 for injecting fuel premixed with the combustion air pass. These orifices are distributed angularly about the engine axis. Sources of combustion are produced downstream of the injection systems. The plane of the orifices is perpendicular to the axis of the combustion sources. In the example shown, the combustion sources with their axis 200 are divergent, forming an angle a relative to the axis of the engine.

To protect the chamber bottom from heat radiation, heat protection screens indicated as baffles 122 are provided. These baffles are substantially flat plates made of refractory material with an opening corresponding to that of the orifices of the injection systems. The baffles are centered on the latter and attached by brazing to the chamber bottom. They are cooled by jets of cooling air entering the chamber through cooling drill holes 124 in the chamber-bottom wall. These jets of air flowing from upstream to downstream are guided by chamber fairings 126, pass through the chamber bottom 116 and by impact cool the upstream face of the baffles 122.

Because of the conicity of the chamber-bottom wall, flat bearing surfaces are made around the orifices of the injection systems to which the baffle shoulders are applied. Since the chamber-bottom wall is a metal sheet, these bearing surfaces are made by local swaging. Dimpling ensures the connection between the swaged surface and the conical surface of the metal sheet.

Technological progress is leading to the production of larger-diameter injection systems. Furthermore efforts are being made to place combustion sources distributed about the axis of the chamber as close as possible to one another in order to obtain optimal combustion.

This then poses the problem of producing bearing surfaces by swaging in the narrowest zone between two adjacent orifices. The closeness of the orifices does not allow the production of these bearing surfaces by swaging.

SUMMARY OF THE INVENTION

The objective of the invention is therefore to allow the attachment of the baffles to the chamber-bottom wall despite the small space separating two adjacent orifices.

Therefore the invention relates to a gas turbine engine annular combustion chamber comprising an outer wall and an inner wall connected by a wall forming a chamber bottom, the walls delimiting sources of combustion with axes inclined relative to the axis of the chamber, the chamber-bottom wall, of frustoconical shape, being pierced with orifices for the fuel injection systems, the planes of the orifices being perpendicular to the axes of the sources of combustion, heat-protection baffles centered on each of the orifices comprising a shoulder by which they rest against a flat surface portion along the periphery of the orifices.

According to the invention, the combustion chamber is characterized in that the chamber-bottom wall is conformed in a succession of adjacent flat facets having a common edge, with one facet per injection system orifice, the shoulder of the baffles resting against the plane of the facets.

Since the surface of the chamber-bottom wall corresponding to a baffle is flat, it is no longer necessary to arrange bearing zones by swaging. The production thereof is greatly simplified. The wall shapes providing the transition between the flat zones and the zones having a conicity are no longer necessary. It is finally possible to produce baffles with a flat surface which is advantageous in manufacture.

Preferably, the intersection of the planes of two adjacent facets forms a straight line passing through the axis of the combustion chamber. The facets are then made simply by metal sheet bending.

This type of chamber-bottom wall production advantageously applies when the minimal distance between two adjacent orifices is less than a value E which corresponds to the minimal metal sheet width in order to be able to produce flat surfaces with a transition zone according to the prior art. Specifically, beyond this value, there are two solutions for producing the chamber bottom. The solution according to the prior art and the solution according to the invention. Beneath this value only the solution of the invention remains possible. An evaluation of this value E is equal to the formula 9*e+2*p+5 in millimeters, in which "e" corresponds to the thickness of the metal sheet forming the chamber bottom and "p" is the width of the shoulder or of the bearing surface of the shoulder of the baffle.

According to one embodiment, the baffles comprise a flat surface portion bordered by two small walls for radial sealing with the chamber bottom.

The invention also relates to a gas turbine engine comprising such a combustion chamber.

BRIEF DESCRIPTION OF THE DRAWINGS

Other features and advantages will emerge from the following description of a nonlimiting embodiment of the invention with reference to the appended drawings in which.

DESCRIPTION OF THE PREFERRED EMBODIMENTS

Figure 1:
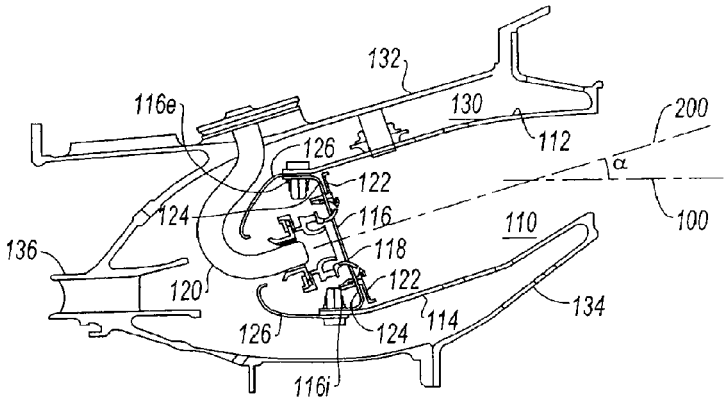
Fig. 1 BACKGROUND ART
FIG. 1 represents an axial half-section of a conventional gas turbine engine annular combustion chamber.
Figure 2:
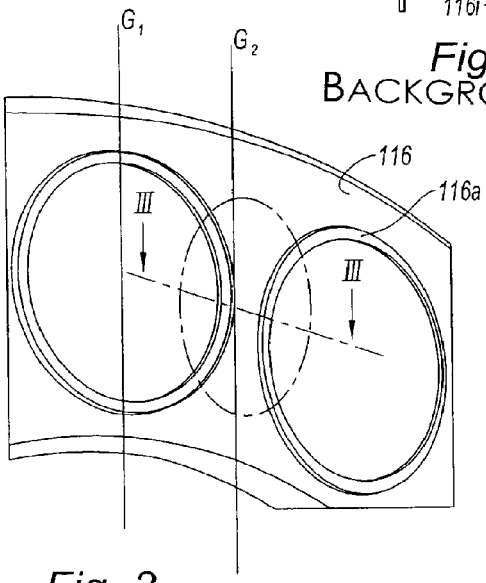
Fig. 2 PRIOR ART
FIG. 2 shows a partial view in perspective of a chamber-bottom wall alone conformed according to the technique of the prior art.

With reference to FIG. 2, a portion of the chamber-bottom wall 116 is seen from the inside of the chamber without the annular walls. The two orifices visible for the injection systems are circular and flat. They are bordered by a flat bearing surface 116*a*. These surfaces 116*a* form a flat bearing surface for the shoulders of the baffles, and are obtained by deformation by swaging of the metal sheet forming the chamber bottom. Since the surface 116 is conical and of the same axis as the engine axis, the deformation is minimal along the generatrix G1 of the cone which passes through the diameter of the orifice and the deformation is maximal along the generatrix G2 which is tangential to the orifices, that is to say in the narrowest zone between two adjacent orifices.

Figure 3:
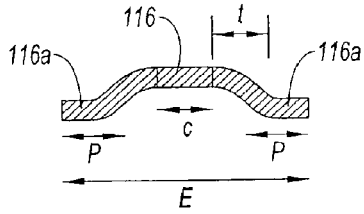
Fig. 3 PRIOR ART
FIG. 3 is a section in the direction III-III of FIG. 2.

FIG. 3 shows, in section in the direction III-III, the shape of the wall in this zone. Over the distance E between the two orifices, there are two flat portions 116*a* forming bearing surfaces with a width p, two rounded transition zones with a width t and the conical wall of the chamber bottom over a width c.

Figure 4:
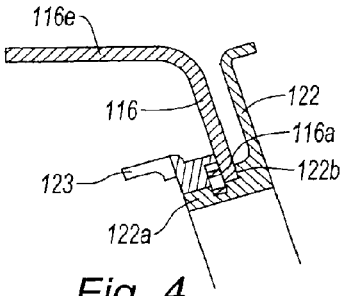
Fig. 4 PRIOR ART
FIG. 4 shows the usual method of attaching a baffle to a chamber bottom wall.

FIG. 4 shows the mounting of a baffle, in section along a generatrix G1. This baffle 122 comprises a cylindrical flange 122*a* adapted so as to be housed in the orifice of the chamber bottom. The outer surface of this flange comprises a shoulder 122*b* which presses on the bearing surface 116*a*. A sheath 123 holds the baffle against the bearing surface 116*a*. The whole is conveniently brazed.

Figure 5:
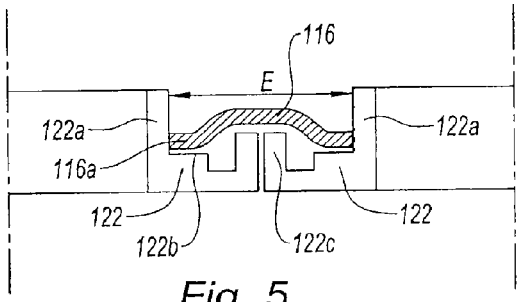
Fig. 5 PRIOR ART
FIG. 5 shows in section the arrangement of the baffles in the narrowest zone between two adjacent orifices.

FIG. 5 shows the mounting of the baffle seen in the zone of FIG. 3. The shoulder 122*b* of the two baffles 122 is pressing on the bearing surface 116*a* of the wall 116. Small walls 122*c*, extending along the lateral edges and oriented radially relative to the axis of the chamber, provide the seal and prevent the gases of the combustion chamber from traveling in the space between the bottom of the chamber and the baffle. These small walls are perpendicular to the plane of the baffle.

This zone is conveniently cooled by drill holes not shown for the jets of air for cooling by impact.

When the orifices of the injection system increase in diameter or else when they become great in number, the distance E separating two adjacent orifices becomes insufficient to allow the production by swaging both of the bearing surfaces 116*a* and the transition zones.

Figure 6:
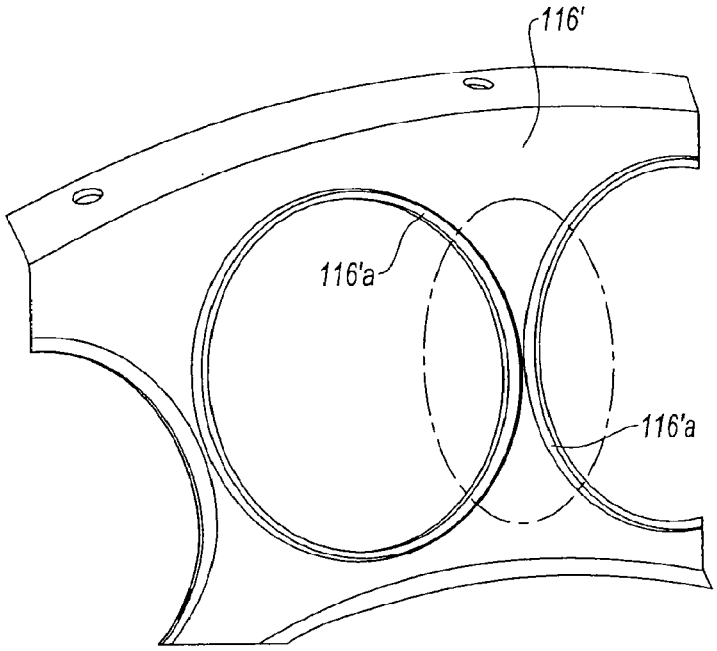
Fig. 6 PRIOR ART
FIG. 6 shows in perspective a chamber-bottom wall according to the teaching of the prior art when the orifices are too close.

It is determined that this minimal value, beneath which the deformation of the metal sheet is no longer mechanically possible by industrial metalworking means, is substantially equal in millimeters to the value expressed by the following formula: 9*e+2*p+5 where "e" is the thickness of the metal sheet forming the chamber-bottom wall and "p" the width of the shoulder 122*b* corresponding to the width that must be provided for the bearing surface 116*a*. FIG. 6 shows such a case of a chamber-bottom wall 116' in which the orifices are too close for the dimpling between the bearing surfaces 116' a to be still possible.

For example for a value e=1.5 mm and p=1.5 mm, the minimal value of the space separating two orifices for the passage of the fuel injectors is 21.5 mm.

This wall geometry therefore limits the possibilities of upgrading of the chambers using more sophisticated injection systems.

Figure 7:
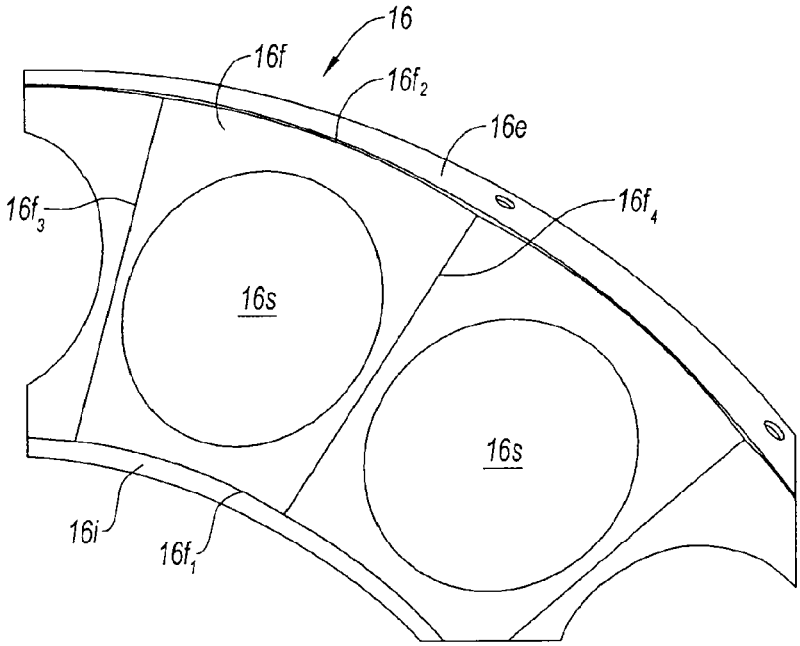
FIG. 7 shows in perspective the solution of the invention in which the chamber-bottom wall is conformed in flat facets centered on the orifices of the injection systems.

FIG. 7 shows the solution of the invention. The annular chamber-bottom wall 16 extends between two flanges, a radially inner flange 16*i* and a radially outer flange 16*e* by which the wall is attached to the inner and outer walls of the annular combustion chamber, not shown because not involved in the invention.

The wall comprises the orifices 16*s* for the injection systems. The generally frustoconical-shaped wall consists of flat facets 16*f* surrounding each of the orifices 16*s*. These facets are therefore delimited by four sides, two sides in an arc of a circle 16*f*1 and 16*f*2. The radially inner side 16*f*1 is bordered by the flange 16*i* for attachment to the inner wall of the combustion chamber. The radially outer side 16*f*2 is bordered by the flange 16*e* for attachment to the outer wall of the combustion chamber. The other two sides 16*f*3 and 16*f*4 are rectilinear and are common to two adjacent facets. They are oriented in a radial direction passing through the axis of the engine. These sides are obtained simply by sheet metal bending. The wall 16 is thus formed of a bended sheet of metal.

Not only is the wall simpler to produce because of the simplification of its geometry but efficiency also increases.

Figure 8:
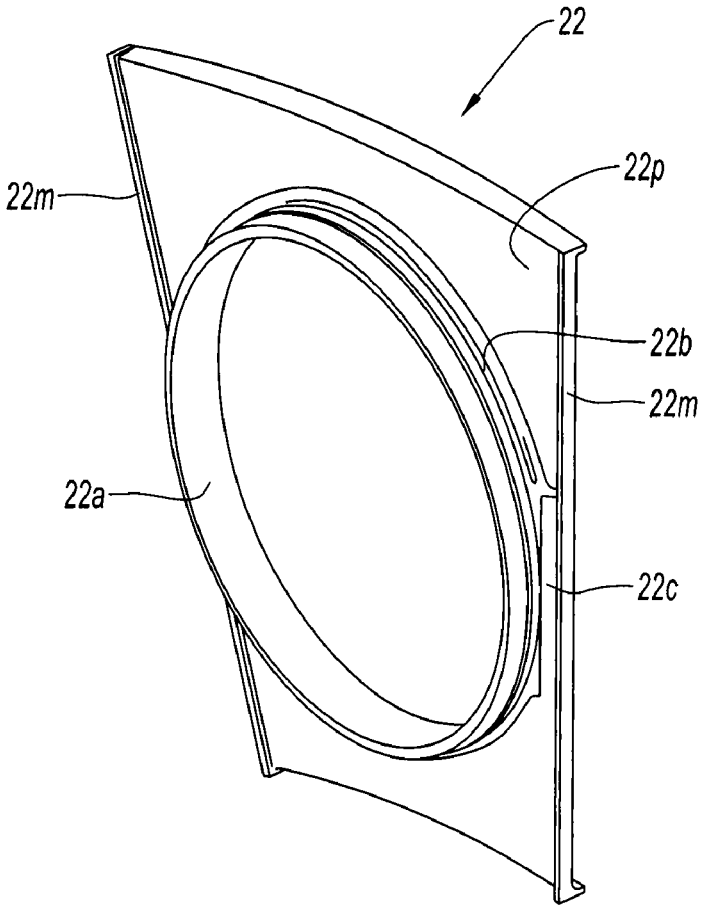
FIG. 8 shows a baffle matching the chamber-bottom wall of the invention seen in perspective.

FIG. 8 shows a baffle complying with this new chamber-bottom geometry. The baffle 22 comprises a flat wall 22*p* which is positioned parallel to the flat facet of the chamber bottom. A circular flange 22*a* borders the orifice corresponding to that of the chamber bottom. This flange comprises externally a shoulder 22*b* which presses on the flat surface of the facet 16*f*. Two small lateral walls 22*m* provide the seal between two adjacent baffles. In the zone corresponding to the space between two adjacent baffles, the baffle has, as necessary, an increased thickness 22*c*.

Figure 9:
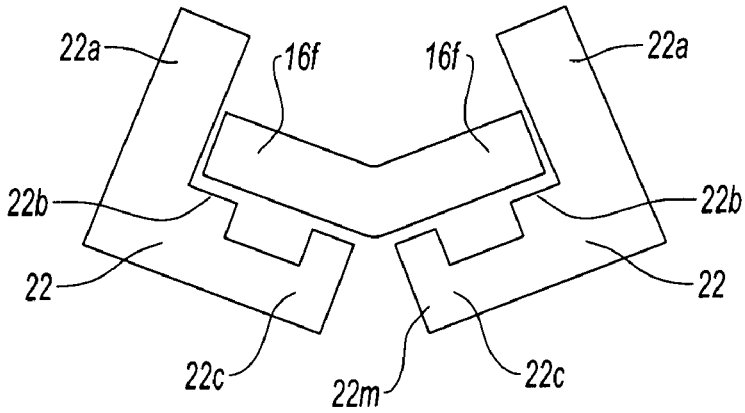
FIG. 9 shows in section the solution of the invention in the space between two orifices of adjacent injection systems.

FIG. 9 shows this zone on the chamber bottom in section between two adjacent orifices. Two baffles 22 are pressing via their shoulder 22*b* on their respective facet 16*f* bordering the orifices of the injection systems. The baffles are held each by a sleeve, not shown here, that is slid around the circular flange on the side away from the shoulder 22*b* and clamping together with the shoulder 22*b* the chamber bottom wall 16*f*.

Therefore, by the facet-shape of the chamber bottom wall it is no longer necessary to produce transition zones between flat surface portions and conical surface portions. It is possible to have fuel injectors in larger numbers and/or injection systems of greater diameter for better combustion. In addition, the baffles being flat, the space between the chamber bottom wall and the baffles is flat ensuring an even flow of the cooling air in this space.

According to the exemplary embodiment shown, the chamber is of the divergent type, that is to say that the vertex of the cone formed by the chamber bottom wall is downstream relative to it and the axes of the sources of combustion associated with the injectors diverge from the engine axis in the downstream direction.

The invention also applies to a combustion chamber of the convergent type, that is to say wherein the vertex of the cone formed by the chamber bottom wall is situated upstream relative to itself and the axes of the sources of combustion associated with the injectors converge on the axis of the engine in the downstream direction.

The invention claimed is:

1. A gas turbine engine annular combustion chamber comprising:

an outer wall;

an inner wall;

a chamber-bottom wall connecting the outer wall and the inner wall such that the outer, inner and chamber-bottom walls delimit sources of combustion with axes inclined relative to an axis of the chamber, the chamber-bottom wall, of frustoconical shape, being pierced with orifices for the fuel injection systems, planes of the orifices being perpendicular to the axes of said sources of combustion; and heat-protection baffles centered on each of the orifices comprising a flat shoulder which rest against a flat surface portion of the chamber-bottom wall along a periphery of the orifices, wherein the chamber-bottom wall includes a succession of adjacent flat facets surrounding each of the orifices, each of the flat facets including a radially inner side, a radially outer side, and two rectilinear sides connecting the radially inner side and the radially outer side, the rectilinear sides being continuous with and common to two adjacent facets, are formed of a bended sheet of metal, and are oriented in a radial direction passing through an axis of the engine, and wherein the adjacent flat facets form a V-shape with an apex extending in a downstream direction with respect to gas flow such that the shoulder of the baffles rests against downstream sides of the facets.

2. The chamber as claimed in claim 1, wherein the intersection of the planes of two adjacent facets forms a straight line passing through the axis of the combustion chamber.

3. The chamber as claimed in claim 1, wherein the minimal distance between two adjacent orifices is less than a value E=9*e+2*p+5 in mm, with "e" corresponding to the thickness of the metal sheet forming the chamber-bottom wall and "p" the width of said shoulder.

4. The combustion chamber as claimed in claim 3, wherein the minimal distance between two orifices is less than 21.5 mm for a wall thickness e=1.5 mm.

5. The combustion chamber as claimed in claim 4, wherein the width of the shoulder is p=1.5 mm.

6. The combustion chamber as claimed in claim 1, wherein the baffles comprise a flat surface portion bordered by two small lateral walls for a seal with the chamber bottom.

7. The combustion chamber as claimed in claim 1, wherein each baffle has an increased thickness in a zone corresponding to a space between two adjacent baffles.

8. The combustion chamber as claimed in one of claims 1 to 6 of the divergent type.

9. A gas turbine engine comprising a combustion chamber as claimed in one of claims 1 to 6.

* * * * *